US009182188B2

(12) United States Patent
Gawencki

(10) Patent No.: US 9,182,188 B2
(45) Date of Patent: Nov. 10, 2015

(54) SOUND SUPPRESSOR

(71) Applicant: FloDesign Inc., Wilbraham, MA (US)

(72) Inventor: Jason Gawencki, Windsor, CT (US)

(73) Assignee: FloDesign, Inc., Wilbraham, MA (US)

( * ) Notice: Subject to any disclaimer, the term of this patent is extended or adjusted under 35 U.S.C. 154(b) by 51 days.

(21) Appl. No.: 14/271,879

(22) Filed: May 7, 2014

(65) Prior Publication Data

US 2015/0267987 A1 Sep. 24, 2015

Related U.S. Application Data

(60) Provisional application No. 61/820,615, filed on May 7, 2013.

(51) Int. Cl.
*F41A 21/30* (2006.01)
*F41A 21/34* (2006.01)

(52) U.S. Cl.
CPC ..... *F41A 21/34* (2013.01); *F41A 21/30* (2013.01)

(58) Field of Classification Search
CPC ..... F41A 21/00; F41A 21/30; F41A 21/32; F41A 21/34; F41A 21/36; F41A 21/38; F41A 21/325
USPC ..... 89/14.05, 14.1–14.5; 42/79, 77, 90; 181/223
See application file for complete search history.

(56) References Cited

U.S. PATENT DOCUMENTS 1,259,251 A * 3/1918 Love ..... F41A 21/30 181/223
2,925,755 A * 2/1960 Krus ..... F27B 7/2075 89/14.3
3,385,164 A * 5/1968 Hubner ..... F41A 21/30 181/223
3,478,841 A 11/1969 Hubner
4,291,610 A * 9/1981 Waiser ..... F41A 21/30 89/14.4
4,576,083 A * 3/1986 Seberger, Jr. ..... F01N 1/08 181/223
4,588,043 A 5/1986 Finn
4,907,488 A * 3/1990 Seberger ..... F41A 21/30 181/223
5,679,916 A * 10/1997 Weichert ..... F41A 21/30 181/223
6,308,609 B1 * 10/2001 Davies ..... F41A 21/30 181/223
6,374,718 B1 4/2002 Rescigno et al.
6,516,698 B1 2/2003 Poff, Jr.
6,575,074 B1 * 6/2003 Gaddini ..... F41A 21/34 89/14.4
7,237,467 B1 * 7/2007 Melton ..... F41A 21/30 89/14.4
7,308,967 B1 12/2007 Hoel
7,661,349 B1 2/2010 Brittingham
7,987,944 B1 8/2011 Brittingham et al.
8,511,425 B2 * 8/2013 Larue ..... F41A 21/30 181/223

(Continued)

OTHER PUBLICATIONS

International Search Report and Written Opinion for PCT/US2014/037104.

*Primary Examiner* — Jonathan C Weber
(74) *Attorney, Agent, or Firm* — Richard M. Klein; Fay Sharpe LLP

(57) ABSTRACT

A sound suppressor is disclosed. The suppressor includes a housing that contains at least one stepped baffle. Each stepped baffle contains multiple stepped diameters and slots located at the base of each step to allow flow from one side of the baffle to the other. The baffle also includes a central passageway through which the projectile/bullet passes.

20 Claims, 6 Drawing Sheets

(56) References Cited

U.S. PATENT DOCUMENTS 8,579,075 B2 * 11/2013 Brittingham ..... F41A 21/30 181/223
8,910,745 B2 * 12/2014 Latka ..... F41A 21/30 181/223
8,991,552 B2 * 3/2015 Latka ..... F41A 21/30 181/223
2010/0163336 A1 7/2010 Presz, Jr. et al.
2011/0056111 A1 * 3/2011 Brittingham ..... F41A 21/30 42/90
2012/0180352 A1 7/2012 Addis

* cited by examiner

SOUND SUPPRESSOR

CROSS-REFERENCE TO RELATED APPLICATIONS

This application claims priority to U.S. Provisional Patent Application Ser. No. 61/820,615, filed on May 7, 2013. The entirety of that application is hereby fully incorporated by reference herein.

STATEMENT REGARDING FEDERALLY SPONSORED RESEARCH OR DEVELOPMENT

This invention was made with government support under Contract No. M67854-11-C-6505 awarded by the Marine Corps System Command. The government has certain rights in the invention.

BACKGROUND

The present disclosure relates to devices for noise and flash suppression for firearms.

Reducing noise and flash from military and security personnel firearms (e.g., long guns and pistols) provides a significant tactical advantage in the field. For military personnel, reduced sound levels will also reduce associated hearing loss. Additionally, application of sound suppression to civilian firearms reduces the objectionable noise to area residents and when used for hunting, to other hunters. Suppressors do not "silence" the gunshot. Instead, they reduce the level of sound associated with the detonation of the propellant.

The blast characteristics include three core elements. The first two core elements are: the precursor blast and a main blast set up by the expanding gases. The precursor blast consists of mostly air with a small amount of propellant and the main blast is made up of spherical pressure waves that quickly overtake the fired projectile. Both of these blasts are sources of low frequency noise that carry for very long distances. The third core element is the highly visible gas flash which follows the blast.

In general, the flash phenomena occur in two ways. Ammunition propellant is typically fuel rich, leaving unburned powder in the exhaust gases. As these high pressure exhaust gases leave the muzzle, the flow immediately expands and a shock wave is formed. Typically the expansion forms a small glowing cone immediately following the muzzle, then several diameters away a large disk like shock wave forms, known as the mach disk. In these two regions, temperature and pressure levels change almost instantly. These sudden energy changes cause the exhaust gases to radiate light, known as the primary and intermediate flash, respectively.

As the unburned powder travels through this mach disk, the sudden temperature spike, along with the presence of oxygen in the ambient air allow these gases to reignite, generating a significant amount of visual signature. This is known as secondary flash.

To minimize the flash and the percussive level, it is necessary to slow the gases exiting the muzzle. This needs to be accomplished without altering the accuracy of the firearm.

BRIEF SUMMARY

The present disclosure relates to a flash and sound suppressor for firearm applications. The suppressor attaches to the muzzle of the firearm and provides a path for a bullet fired from that firearm to pass uninterrupted through the suppressor. The suppressor comprises an outer housing with a means of attaching to the firearm muzzle. Baffles of a specific configuration are arranged inside the solid tubular housing, and create multiple, convoluted flow paths to slow a substantial portion of the exiting propellant mixture. Spacers are incorporated to locate the baffles axially in the depicted embodiment; however welding or alternate means may be used.

The outer housing is capped by a threaded closure at the exit end, that closure having an optional castellated feature for both assembly/disassembly and military field use.

Although a threaded connection is shown for the connection to the firearm, a quick-disconnect or other embodiment would be equivalent.

Disclosed in various embodiments herein are flash and noise suppressors for a firearm, comprising: an outer tubular housing having a longitudinal length, an upstream end, and a downstream end; an adapter at the upstream end of the housing for connecting the suppressor to the firearm, the adapter providing an entrance; an exit at the downstream end of the housing; a first expansion chamber downstream of the entrance; and a first stepped baffle element downstream of the first expansion chamber, formed from a plurality of concentric rings that increase in diameter in a downstream direction, each upstream ring being connected to a successive downstream ring by a circumferential sidewall, the ring and the circumferential sidewall forming a step of the stepped baffle element, each circumferential sidewall having slots to allow flow from an upstream side of the baffle element to a downstream side of the baffle element, each concentric ring having a central passageway to allow a projectile to pass through.

In some embodiments, the suppressor may further comprise a second stepped baffle element arranged downstream of the first stepped baffle element, the second stepped baffle element being nested in the first stepped baffle element, the first and second stepped baffle element together forming a first baffle stage.

The concentric ring of the first stepped baffle element having the largest diameter may include a downstream circumferential sidewall that spaces the first stepped baffle element from the second stepped baffle element. Sometimes, the first baffle element is welded to the second baffle element. If desired, the first baffle stage further comprises a third stepped baffle element arranged downstream of and nested in the second stepped baffle element.

The suppressor may further include a second baffle stage downstream of the first baffle stage, the two baffle stages being separated by a second expansion chamber. A spacer may separate the first baffle stage and the second baffle stage.

The slots of the baffle element can be any shape, such as rectangular or circular.

Sometimes, the adapter includes threads for attaching the suppressor to an associated firearm. Alternatively, the adapter can include a quick disconnect attachment for connecting to an associated firearm.

In particular embodiments, the adapter is made separately from the outer tubular housing, and includes threads at one end for attaching the adapter to the upstream end of the outer tubular housing. The adapter may be conically shaped and expand to open into the first expansion chamber.

The downstream end of the tubular housing can be threaded to accept a closure element, the closure element comprising a disk containing the exit, and a circumferential sidewall having threads for engaging the downstream end of the tubular housing. The closure element may also include a conical protrusion on an internal side of the disk surrounding the exit.

Also disclosed in various embodiments herein are flash and noise suppressors for a firearm, comprising: a suppressor housing; an adapter at an inlet end of the housing; an exit orifice at a discharge end of the housing; and at least one stepped baffle element located within the housing, wherein the stepped baffle element comprises a plurality of steps, the steps being concentric and each step comprising: an annular disk surrounding a central passageway and having an outer diameter; and a circumferential sidewall, wherein the circumferential sidewall has an inner diameter and slots that permit flow from an exterior side of the circumferential sidewall into the central passageway; wherein the circumferential sidewall of an upstream step contacts the annular disk of the adjacent downstream step, and wherein the outer diameter of the downstream step is greater than the outer diameter of the upstream step.

The inner diameter of the furthest downstream step may be greater than the outer diameter of the furthest upstream step. In particular embodiments, the stepped baffle element has at least three steps.

The slots of each step can be rectangular or circular. The slots of each step may be spaced evenly around the circumferential sidewall. Each slot may occupy an arc of from 30° to 150° of the circumferential sidewall.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
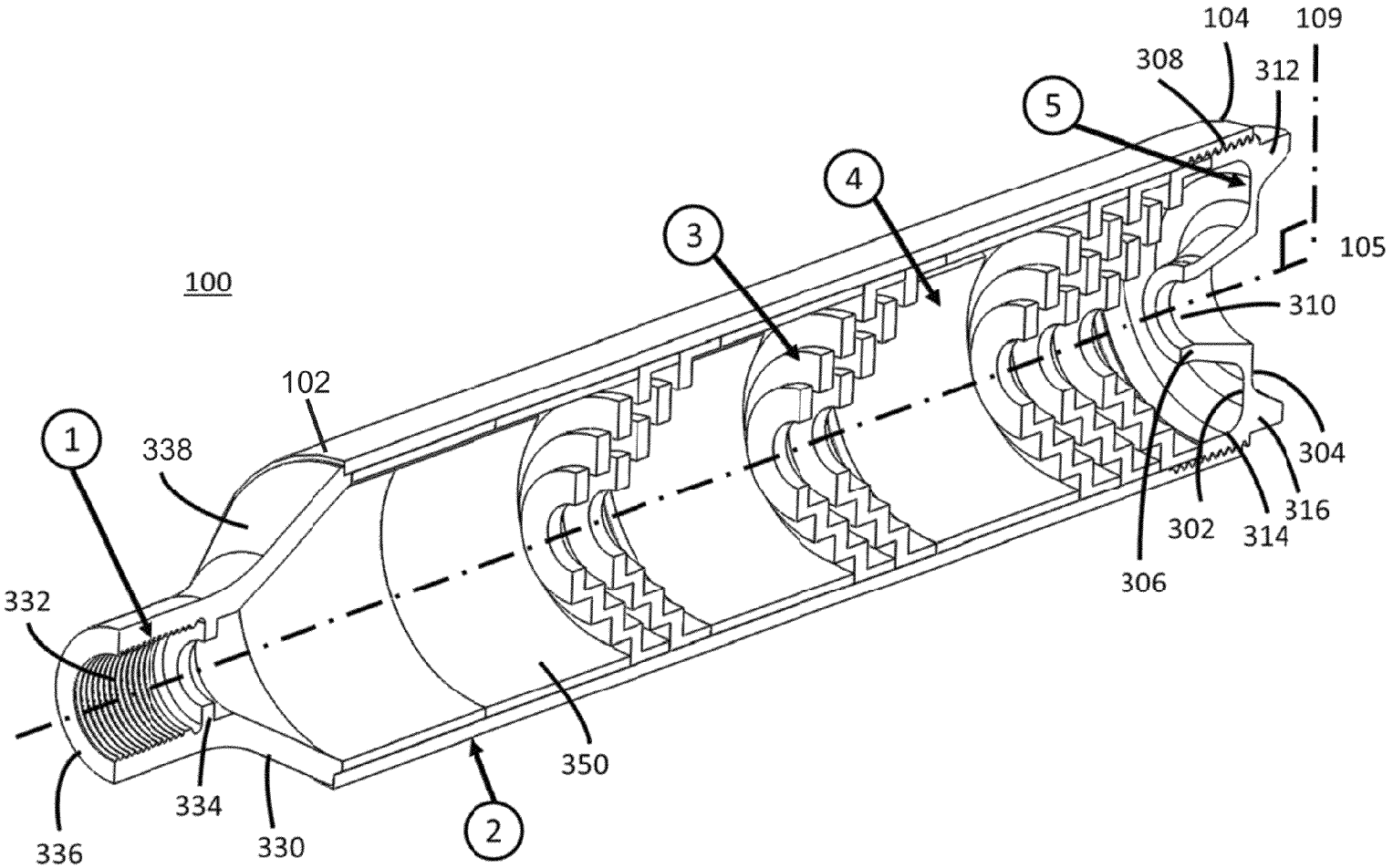
FIG. 1 is an isometric cross-sectional view of a suppressor of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any impurities that might result therefrom, and excludes other ingredients/steps.

Numerical values should be understood to include numerical values which are the same when reduced to the same number of significant figures and numerical values which differ from the stated value by less than the experimental error of the conventional measurement technique used to determine the value.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

Some of the terms used herein are relative terms. For example, the terms "interior", "exterior", "inner", and "outer" are relative to a center. Similarly, the terms "left" and "right" are relative to a center, though these two particular terms are generally used to refer to locations equidistant from the center, e.g. a "left corner" and a "right corner". These terms should not be construed as requiring a particular orientation.

The terms "inlet" and "outlet" are relative to an object passing through them with respect to a given structure, e.g. a bullet enters through the inlet into the suppressor housing and exits through the outlet out of the structure. The terms "upstream" and "downstream" are relative to the direction in which an object passes through/past various components, i.e. the object passes through an upstream component prior to passing through the downstream component.

The terms "top" and "bottom" are used to refer to surfaces where the top is always higher than the bottom relative to an absolute reference, i.e. the surface of the earth. The terms "above" and "below" are also used to refer to the location of two structures relative to an absolute reference.

The present disclosure relates to a suppressor housing that generally has a cylindrical structure. A "longitudinal" axis runs through the center of the cylindrical structure. A "radial" axis is perpendicular to the longitudinal axis.

The present disclosure relates to a firearm suppressor and the baffles incorporated therein. The number of baffles, the use of spacers, the diameter of the tube used as a housing for the suppressor, the muzzle adapter configuration and closure configuration may vary from that shown, and welding may be incorporated for reasons of cost as opposed to use of threaded connections for ease of disassembly for cleaning.

Figure 2:
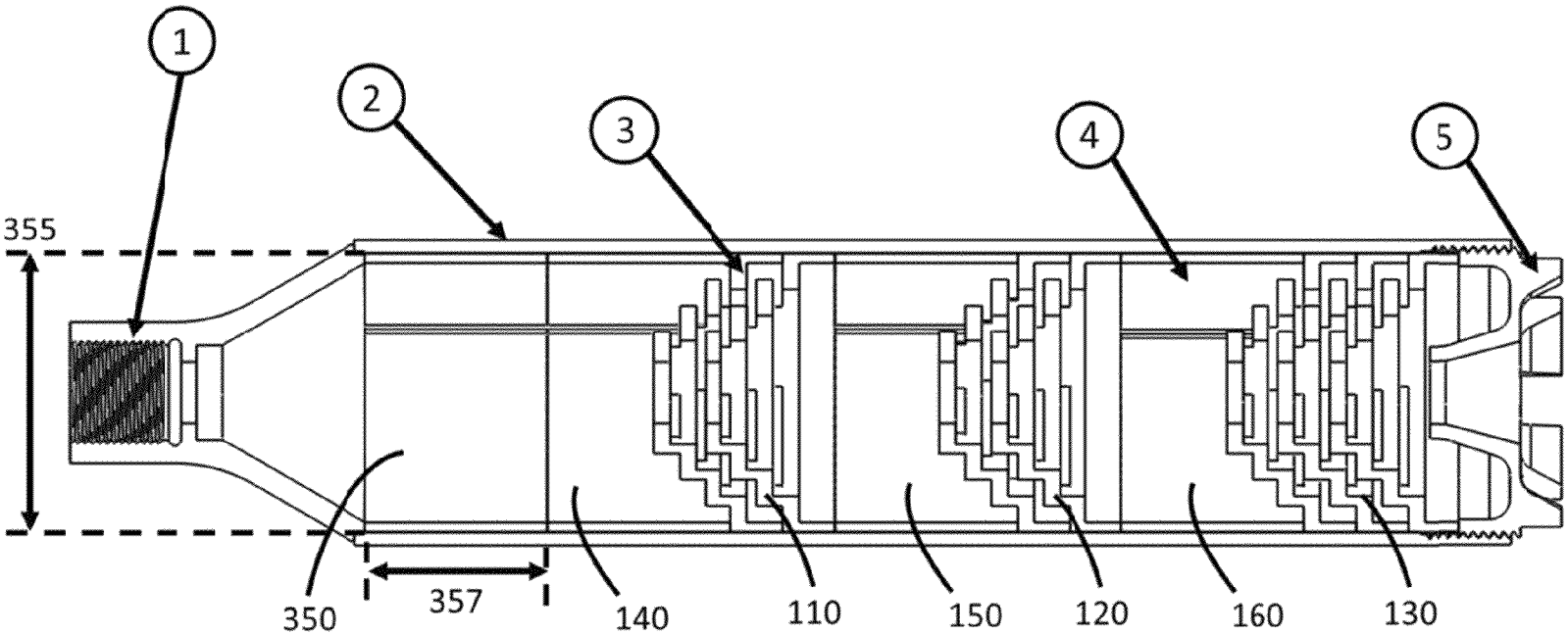
FIG. 2 is a two-dimensional side cross section of the suppressor of FIG. 1. Visible are a threaded connection 1, tubular housing 2, baffle 3, cage-type tubular spacer 4, and threaded closure 5.

Referring to FIGS. 1 and 2, there is a tubular body (2) that acts as a housing and includes a muzzle connecting feature (1), shown here as a threaded connection. Inside the body (2) are incorporated one or more stepped baffles (3) of a configuration more particularly shown in FIGS. 3, 4, and 5.

Referring now to FIG. 1, which is an isometric cross-sectional view along the longitudinal axis, the suppressor housing 100 includes an upstream end/inlet end 102 and a downstream end/discharge end 104 at opposite ends of the housing. A longitudinal axis 105 runs from the upstream end 102 to the downstream end 104. A radial axis 109 is perpendicular to the longitudinal axis. The housing is shown here as having a generally cylindrical shape. The exterior of the housing 100 is formed by muzzle adapter 330, tubular body (2), and closure element 300.

At the upstream end 102 is a muzzle adapter 330 that is used to connect the suppressor to the muzzle of the firearm. The adapter 330 includes an entrance or inlet 336 into the housing. The inlet 336 has internal threads 332 that are intended to be mated with external threads on the muzzle of the firearm to which the suppressor is attached. An annular collar 334 is also present at the upstream end, and controls the depth of the muzzle into the suppressor. The inlet 336 has a smaller outer diameter than the rest of the housing, and a conical wall 338 joins the inlet to the rest of the housing. The muzzle adapter (1) is shown here as a simple threaded connection. However, alternate designs are contemplated. One example of an alternate design is a quick-disconnect configuration.

The downstream end 104 includes a closure element 300 for sealing the internal components of the suppressor. The closure element is generally in the shape of a disk 312 having an inner surface 302, an outer surface 304, and a sidewall 314. External threads 308 are present on the sidewall 314 for mating the closure element 300 with the tubular body (2). An exit orifice 310 is also present at the center of the disk 312. A conical protrusion 306 surrounds the exit orifice and extends from the inner surface 302 of the disk into the interior of the tubular body (2). Castellations 316 may be present on the outer surface 304 of the closure element. Located within the tubular body (2) are sets of baffles (3) separated by spacers (4). Spacers are also indicated with reference numeral 350.

FIG. 2 is a side cross-sectional view of the suppressor. The interior of the tubular body (2) includes a first baffle stage 110, a second baffle stage 120, and a third baffle stage 130. A first expansion chamber 140 is present between the muzzle connecting feature (1) and the first baffle stage 110. A second expansion chamber 150 is present between the first baffle stage 110 and the second baffle stage 120. A third expansion chamber 160 is present between the second baffle stage 120 and the third baffle stage 130. A fourth expansion chamber can be considered as being formed between the third baffle stage 130 and the closure element 300.

Spacers 350 are used to separate the baffle stages from each other. Each spacer has a height 357 and a outer diameter 355. The spacer is formed as a solid wall having no holes therethrough. As illustrated here, two spacers are present in the first chamber 140, and one spacer is present in the second chamber 150 and the third chamber 160. The spacers allow the suppressor to be disassembled and cleaned.

The closure (5) features a conical protrusion 306 into the flow stream, as seen in FIG. 1. This feature forces the expanding gases from the baffle stages to reverse direction prior to exiting the suppressor body through the exit orifice 310.

Figure 3:
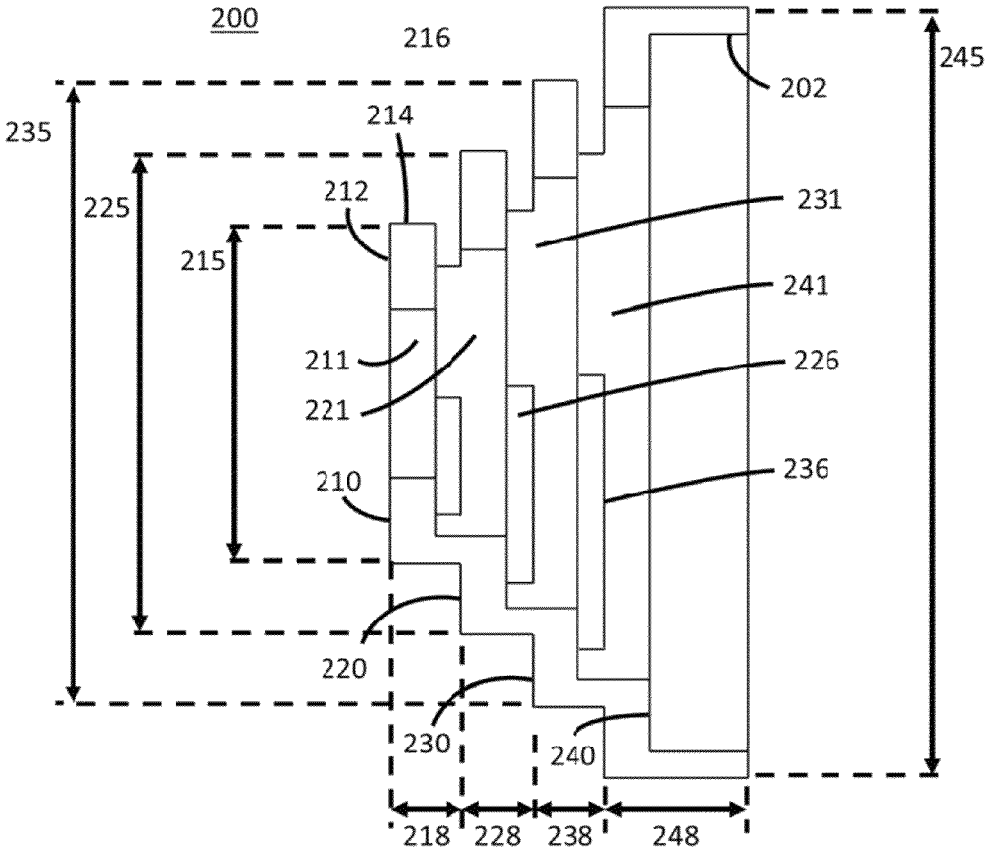
FIG. 3 is a cross-sectional view of a stepped baffle of the present disclosure.
Figure 4:
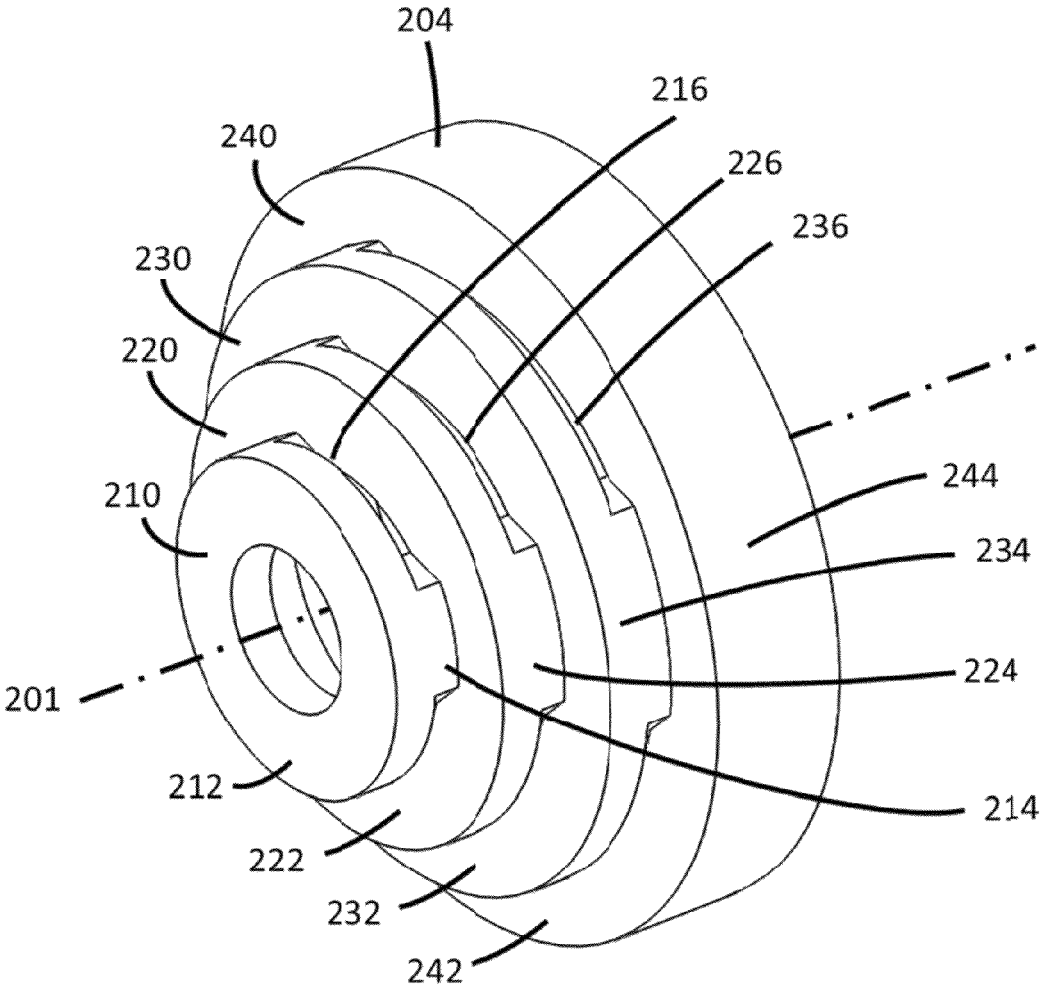
FIG. 4 is a front perspective view of the stepped baffle of FIG. 3.
Figure 5:
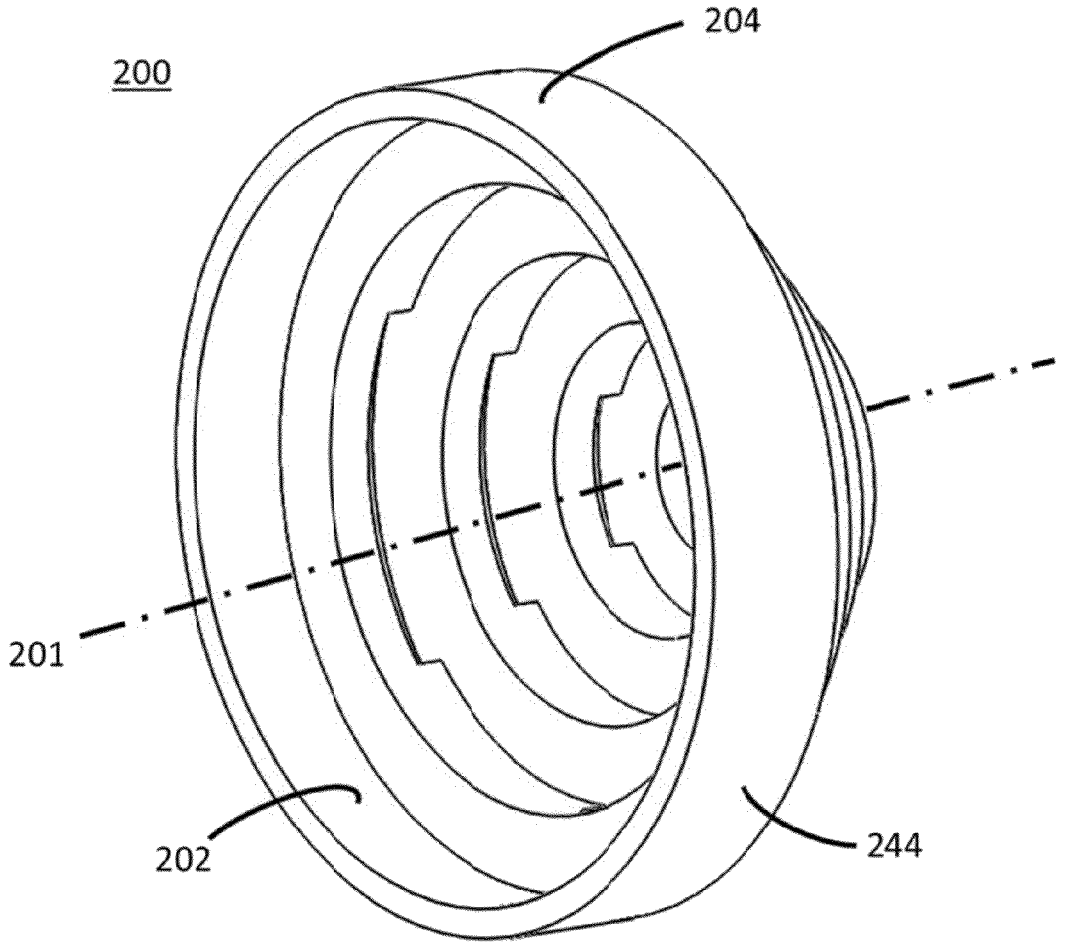
FIG. 5 is a rear perspective view of the stepped baffle of FIG. 3.

FIGS. 3-5 illustrate the stepped baffle element used to make up the baffle stages. FIG. 3 is a side cross-sectional view, FIG. 4 is a front perspective view, and FIG. 5 is a rear perspective view. Each stepped baffle element contains multiple stepped diameters and slots located at the base of each step to allow flow from one side of the baffle to the other. Additionally, each baffle includes a through hole to allow free passage of the projectile. The "sharp edges" and the slots provide significant losses for the gas flow.

Referring now to FIG. 3 and FIG. 4, each baffle 200 can be considered as being formed from a set of concentric disks having different outer diameters and arranged in a step-like manner. In these figures, the baffle 200 has four disks 210, 220, 230, 240 that act as steps. It is contemplated that any number of disks may be used, and in particular embodiments 2 to 6 disks are used, or 3 to 5 disks are used. The resulting baffle 200 includes an inner surface 202 and an outer surface 204. Although described in terms of different disks, the baffle is usually formed as one integral piece.

The first disk 210 has a central passageway 211 at its center. The first disk 210 is formed from a first ring 212. The first ring has a outer diameter 215.

The second disk 220 has a central passageway 221 at its center. The second disk 220 is formed from a second ring 222. The second ring has a outer diameter 225.

The third disk 230 has a central passageway 231 at its center. The third disk 230 is formed from a third ring 232. The third ring has a outer diameter 235.

The fourth disk 240 has a central passageway 241 at its center. The fourth disk 240 is formed from a fourth ring 242. The fourth ring has a outer diameter 245.

The first disk 210 and the second disk 220 are joined together by a circumferential sidewall 214 located around the perimeter of the first disk. The sidewall 214 has a height 218. A plurality of slots 216 pass entirely through the sidewall 214. The sidewall 214 has the same outer diameter as the first disk 210, and together they can be considered a first step if desired. The sidewall 214 also has an inner diameter.

The second disk 220 and the third disk 230 are joined together by a circumferential sidewall 224 located around the perimeter of the second disk. The sidewall 224 has a height 228. A plurality of slots 226 pass entirely through the sidewall 224. The sidewall 224 has the same outer diameter as the second disk 220, and together they can be considered a second step if desired. The sidewall 224 also has an inner diameter.

The third disk 230 and the fourth disk 240 are joined together by a circumferential sidewall 234 located around the perimeter of the third disk. The sidewall 234 has a height 238. A plurality of slots 236 pass entirely through the sidewall 234. The sidewall 234 has the same outer diameter as the third disk 230, and together they can be considered a third step if desired. The sidewall 234 also has an inner diameter.

A circumferential sidewall 244 is located around the perimeter of the fourth disk 240, and extends in a downstream direction. Unlike the other three circumferential sidewalls 214, 224, 234, no slots are present. The sidewall 244 has the same outer diameter as the fourth disk 240, and together they can be considered a fourth step if desired. The sidewall 244 also has an inner diameter.

As can be seen in FIG. 3, the outer diameter 215 of the first ring is smaller than the outer diameter 225 of the second ring, which in turn is smaller than the outer diameter 235 of the third ring, which in turn is smaller than the outer diameter 245 of the fourth ring. It is noted that the outer diameter 245 of the fourth ring is substantially equal to the outer diameter 355 of the spacers (see FIG. 2). Put another way, the concentric rings increase in diameter in a downstream direction. In addition, the diameter of the central passageway 211 of the first ring is smaller than the diameter of the central passageway 221 of the second ring, which in turn is smaller than the diameter of the central passageway 231 of the third ring, which in turn is smaller than the diameter of the central passageway 241 of the fourth ring. This results in the baffle having a central passageway 201 through which the bullet can pass. Each upstream ring is connected to its adjacent downstream ring through a circumferential sidewall, which can be considered a longitudinal support.

In addition, baffles can be nested within each other. As seen in FIG. 2, the first baffle stage 110 and the second baffle stage 120 are formed by nesting two baffles together. Put another way, referring again to FIG. 3, the diameter of the central passageway 221 of the second ring is greater than the diameter 215 of the first ring, the diameter of the central passageway 231 of the third ring is greater than the diameter 225 of the second ring, and the diameter of the central passageway 241 of the third ring is greater than the diameter 235 of the third ring. The degree of nesting can also be changed by altering the heights of each circumferential sidewall 214, 224, 234, 244 as desired.

The slots 216, 226, 236 permit exhaust gases to flow from the upstream side of the baffle to the downstream side of the baffle element, i.e. from outer surface 204 to inner surface 202. It is noted that the slots 216, 226, 236 are usually sized so as to take up the majority of the circumference of each circumferential sidewall 214, 224, 234. If the sidewall is considered as having a 360° arc, the slots take up at least 180° of the arc. As illustrated here, the slots take up 240° of the arc. In various embodiments, the slots will take up from 180° to 300° of the arc. Each individual slot may take up from 30° to 150° of the arc. There may be a total of from 2 to 6 separate slots. The slots are usually spaced evenly about the circumference. The remaining portion of the circumferential sidewall can be considered a longitudinal support joining two rings together.

FIG. 5 shows the rear of the baffle 200. The central passageway 201 through which the bullet travels can be more easily seen, as can the inner surface 202 and the outer surface 204. For reference, the circumferential sidewall 244 downstream of the fourth ring is also indicated. Please note that the reference numeral 202 refers to the entire inner surface of the resulting formed baffle, and the reference numeral 204 refers to the entire outer surface of the formed baffle.

Figure 6:
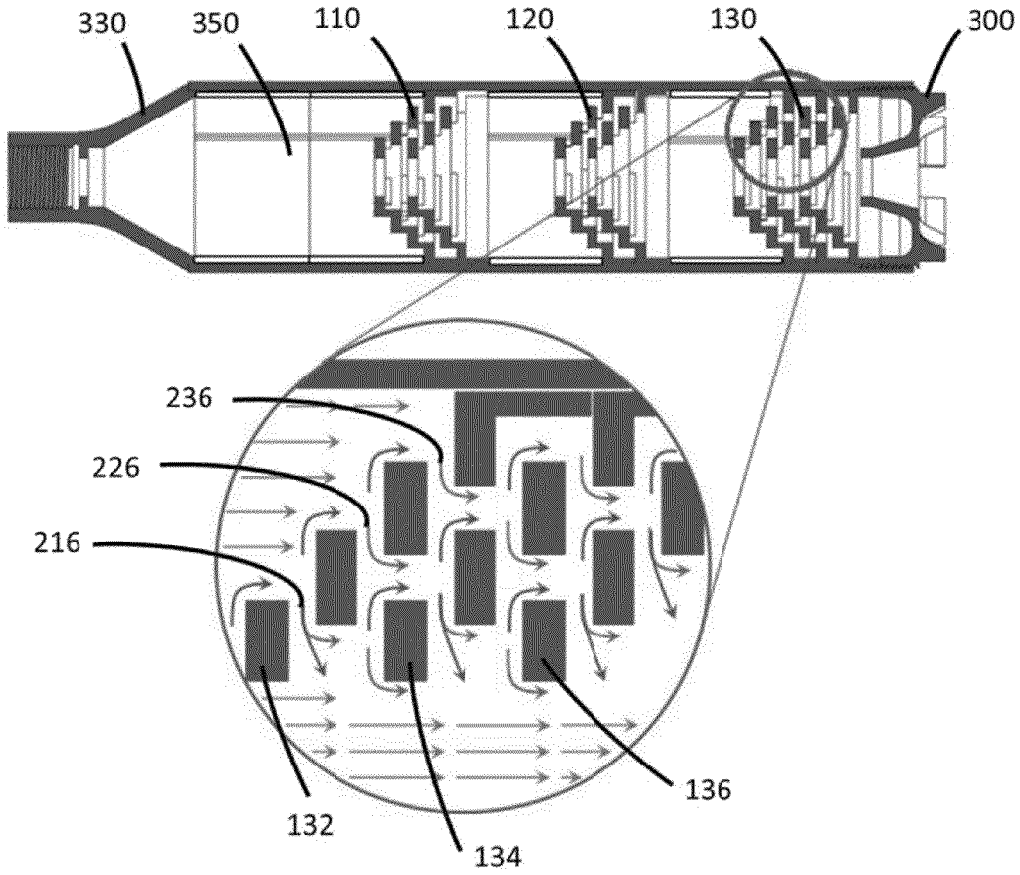
FIG. 6 is a magnified view that shows the multiple flow paths resulting from the baffle configuration. A stack of three stepped baffle elements is shown in this view.

FIG. 6 is a magnified view of the baffles and gas flow through the slots. The third baffle stage 130 is shown, having three nested baffles 132, 134, 136. The slots 216, 226, 236 of the baffle 132 are also shown. When arranged with multiple baffles in series as shown, the gas flow outside the projectile path centerline is slowed by passage through the multiple slots, and rejoins the main exit flow at the closure element (5), sufficiently later than the initial primary blast wave to allow expansion with reduced percussive result.

adapterThe stepped baffle creates multiple flow paths for the exhaust gas. The number of steps may be varied; here, the baffles are depicted as having four steps. As noted, each step includes slots through which gases will pass. The shape of each slot can be varied, e.g. being rectangular or circular, as long as a flow path is created that is on an axis that is not parallel with the trajectory of the projectile (i.e. not along the longitudinal axis). The conical protrusion (306 in FIG. 3) causes the exhaust gas traveling along the wall of the tubular body (2) to have to turn abruptly before rejoining the exiting flow stream and passing through the exit orifice 310.

As previously noted, the baffles may be nested into each other. This is best seen in FIG. 6. The combination of baffles and spacers may vary as well. Nested baffle stages can be welded together if desired.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A flash and noise suppressor for a firearm comprising:

an outer tubular housing having a longitudinal length, an upstream end, and a downstream end;

an adapter at the upstream end of the housing for connecting the suppressor to the firearm, the adapter providing an entrance;

an exit at the downstream end of the housing;

a first expansion chamber downstream of the entrance; and a first stepped baffle element downstream of the first expansion chamber, formed from a plurality of concentric rings that increase in diameter in a downstream direction, each upstream ring being connected to a successive downstream ring by a circumferential sidewall, the ring and the circumferential sidewall forming a step of the stepped baffle element, each circumferential sidewall having slots to allow flow from an upstream side of the baffle element to a downstream side of the baffle element, each concentric ring having a central passageway to allow a projectile to pass through.

2. The suppressor of claim 1, further comprising a second stepped baffle element arranged downstream of the first stepped baffle element, the second stepped baffle element being nested in the first stepped baffle element, the first and second stepped baffle element together forming a first baffle stage.

3. The suppressor of claim 2, wherein the concentric ring of the first stepped baffle element having the largest diameter includes a downstream circumferential sidewall that spaces the first stepped baffle element from the second stepped baffle element.

4. The suppressor of claim 2, wherein the first baffle element is welded to the second baffle element.

5. The suppressor of claim 2, wherein the first baffle stage further comprises a third stepped baffle element arranged downstream of and nested in the second stepped baffle element.

6. The suppressor of claim 2, further including a second baffle stage downstream of the first baffle stage, the two baffle stages being separated by a second expansion chamber.

7. The suppressor of claim 6, wherein a spacer separates the first baffle stage and the second baffle stage.

8. The suppressor of claim 1, wherein the slots are rectangular or circular.

9. The suppressor of claim 1, wherein the adapter includes threads for attaching the suppressor to an associated firearm.

10. The suppressor of claim 1, wherein the adapter includes a quick disconnect attachment for connecting to an associated firearm.

11. The suppressor of claim 1, wherein the adapter is made separately from the outer tubular housing, and includes threads at one end for attaching the adapter to the upstream end of the outer tubular housing.

12. The suppressor of claim 1, wherein the adapter is conically shaped and expands to open into the first expansion chamber.

13. The suppressor of claim 1, wherein the downstream end of the tubular housing is threaded to accept a closure element, the closure element comprising a disk containing the exit, and a circumferential sidewall having threads for engaging the downstream end of the tubular housing.

14. The suppressor of claim 13, wherein the closure element includes a conical protrusion on an internal side of the disk surrounding the exit.

15. A flash and noise suppressor for a firearm comprising:

a suppressor housing;

an adapter at an inlet end of the housing;

an exit orifice at a discharge end of the housing; and at least one stepped baffle element located within the housing, wherein the stepped baffle element comprises a plurality of steps, the steps being concentric and each step comprising:

an annular disk surrounding a central passageway and having an outer diameter; and a circumferential sidewall, wherein the circumferential sidewall has an inner diameter and slots that permit flow from an exterior side of the circumferential sidewall into the central passageway;

wherein the circumferential sidewall of an upstream step contacts the annular disk of the adjacent downstream step, and wherein the outer diameter of the downstream step is greater than the outer diameter of the upstream step.

16. The suppressor of claim 15, wherein the inner diameter of the furthest downstream step is greater than the outer diameter of the furthest upstream step.

17. The suppressor of claim 15, wherein the stepped baffle element has at least three steps.

18. The suppressor of claim 15, wherein the slots of each step are rectangular or circular.

19. The suppressor of claim 15, wherein the slots of each step are spaced evenly around the circumferential sidewall.

20. The suppressor of claim 15, wherein each slot occupies an arc of from 30° to 150° of the circumferential sidewall.

* * * * *